US011090959B2

(12) United States Patent
Nakamura

(10) Patent No.: US 11,090,959 B2
(45) Date of Patent: Aug. 17, 2021

(54) PRINTING APPARATUS, HOME POSITION SETTING METHOD, AND RECORDING MEDIUM

(71) Applicant: Kahei Nakamura, Tokyo (JP)

(72) Inventor: Kahei Nakamura, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 433 days.

(21) Appl. No.: 16/241,814

(22) Filed: Jan. 7, 2019

(65) Prior Publication Data

US 2019/0217641 A1 Jul. 18, 2019

(30) Foreign Application Priority Data

Jan. 12, 2018 (JP) ..... JP2018-003225

(51) Int. Cl.
*B41J 19/20* (2006.01)

(52) U.S. Cl.
CPC ..... *B41J 19/205* (2013.01); *B41J 19/207* (2013.01)

(58) Field of Classification Search
CPC ... B41J 19/00; B41J 19/18; B41J 19/20; B41J 19/202; B41J 19/205; B41J 19/207
See application file for complete search history.

(56) References Cited

U.S. PATENT DOCUMENTS

| | | | |
|---|---|---|---|
| 4,195,938 A | 4/1980 | Velazquez | |
| 2018/0147835 A1 | 5/2018 | Nakamura et al. | |

FOREIGN PATENT DOCUMENTS

| | | | | |
|---|---|---|---|---|
| EP | 0769388 A1 | | 4/1997 | |
| EP | 1086822 | * | 3/2001 | ..... B41J 19/20 |
| JP | 2002-307771 | | 10/2002 | |
| JP | 2004-82638 | * | 3/2004 | ..... B41J 11/42 |
| JP | 2005088544 A | | 4/2005 | |
| JP | 2013-193350 | | 9/2013 | |
| JP | 2014-172366 | * | 9/2014 | ..... B41J 19/18 |

OTHER PUBLICATIONS

European Search Report; Application No. 19150905.8—1019; dated May 23, 2019.

* cited by examiner

*Primary Examiner* — Matthew G Marini
*Assistant Examiner* — Marissa Ferguson-Samreth
(74) *Attorney, Agent, or Firm* — Duft & Bornsen, PC

(57) ABSTRACT

A printing apparatus includes an apparatus body, a carriage, an encoder, a detection target member, a detector, and circuitry. The encoder detects an amount of movement of the carriage in a main scanning direction. The target member on the carriage has a cutout portion halfway in the main scanning direction. The detector on the body detects the target member. The circuitry controls a position setting operation for setting a home position of the carriage based on a detection result of detection or non-detection of the target member. The circuitry measures an output pulse of the encoder from when the detection result changes from detection to non-detection until when the detection result changes from non-detection to detection, and determines whether a measured value of the output pulse is equal to or greater than a predetermined value set based on a width of the cutout portion in the main scanning direction.

6 Claims, 9 Drawing Sheets

PRINTING APPARATUS, HOME POSITION SETTING METHOD, AND RECORDING MEDIUM

CROSS-REFERENCE TO RELATED APPLICATION

This patent application is based on and claims priority pursuant to 35 U.S.C. § 119(a) to Japanese Patent Application No. 2018-003225, filed on Jan. 12, 2018, in the Japan Patent Office, the entire disclosure of which is incorporated by reference herein.

BACKGROUND

Technical Field

The present disclosure relates to a printing apparatus, a home position setting method, and a recording medium.

Related Art

For example, in a printing apparatus to perform printing by moving a carriage including a recording head back and forth, a home position of the carriage needs to be defined accurately.

SUMMARY

In an aspect of the present disclosure, there is provided a printing apparatus that includes an apparatus body, a carriage, an encoder, a detection target member, a detector, and circuitry. The encoder is configured to detect an amount of movement of the carriage in a main scanning direction. The detection target member is disposed on the carriage and has a cutout portion halfway in the main scanning direction. The detector is disposed on the apparatus body and configured to detect the detection target member. The circuitry is configured to control a position setting operation for setting a home position of the carriage based on a detection result of detection or non-detection of the detection target member with the detector. The circuitry is configured to measure an output pulse of the encoder from when the detection result of the detector changes from detection to non-detection until when the detection result changes from non-detection to detection, and determine whether a measured value of the output pulse is equal to or greater than a predetermined value that is set in advance based on a width of the cutout portion in the main scanning direction.

In another aspect of the present disclosure, there is provided a home position setting method for setting a home position of a carriage of an apparatus. The method includes detecting and setting. The detecting detects a detection target member with a detector disposed on an apparatus body of the apparatus. The detection target member is disposed on the carriage that moves in a main scanning direction. The detection target member has a cutout portion halfway in the main scanning direction. The setting sets a home position of the carriage based on a detection result of detection or non-detection of the detection target member with the detector. The setting includes measuring and determining. The measuring measures an output pulse of an encoder detecting a movement amount of the carriage from when the detection result of the detector changes from detection to non-detection until when the detection result changes from non-detection to detection. The determining determines whether a measured value of the output pulse is equal to or greater than a predetermined value that is set in advance based on a width of the cutout portion in the main scanning direction.

In still another aspect of the present disclosure, there is provided a non-transitory recording medium storing computer-readable program code which causes a computer to execute processing. The processing includes detecting and setting. The detecting detects a detection target member with a detector disposed on an apparatus body of the apparatus. The detection target member is disposed on the carriage that moves in a main scanning direction. The detection target member has a cutout portion halfway in the main scanning direction. The setting sets a home position of the carriage based on a detection result of detection or non-detection of the detection target member with the detector. The setting includes measuring and determining. The measuring measures an output pulse of an encoder detecting a movement amount of the carriage from when the detection result of the detector changes from detection to non-detection until when the detection result changes from non-detection to detection. The determining determines whether a measured value of the output pulse is equal to or greater than a predetermined value that is set in advance based on a width of the cutout portion in the main scanning direction.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
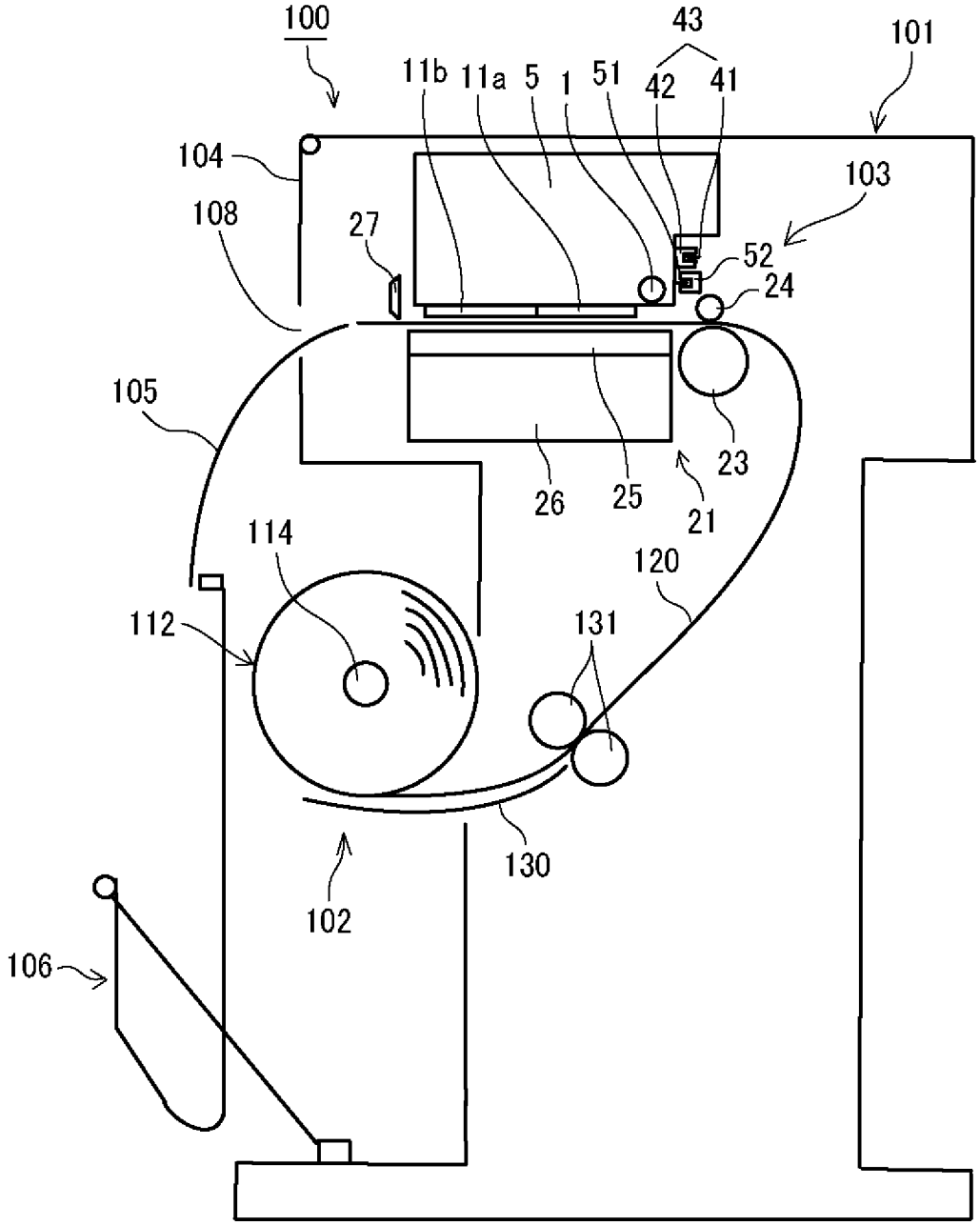
FIG. 1 is a schematic explanatory side view of a printing apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Figure 2:
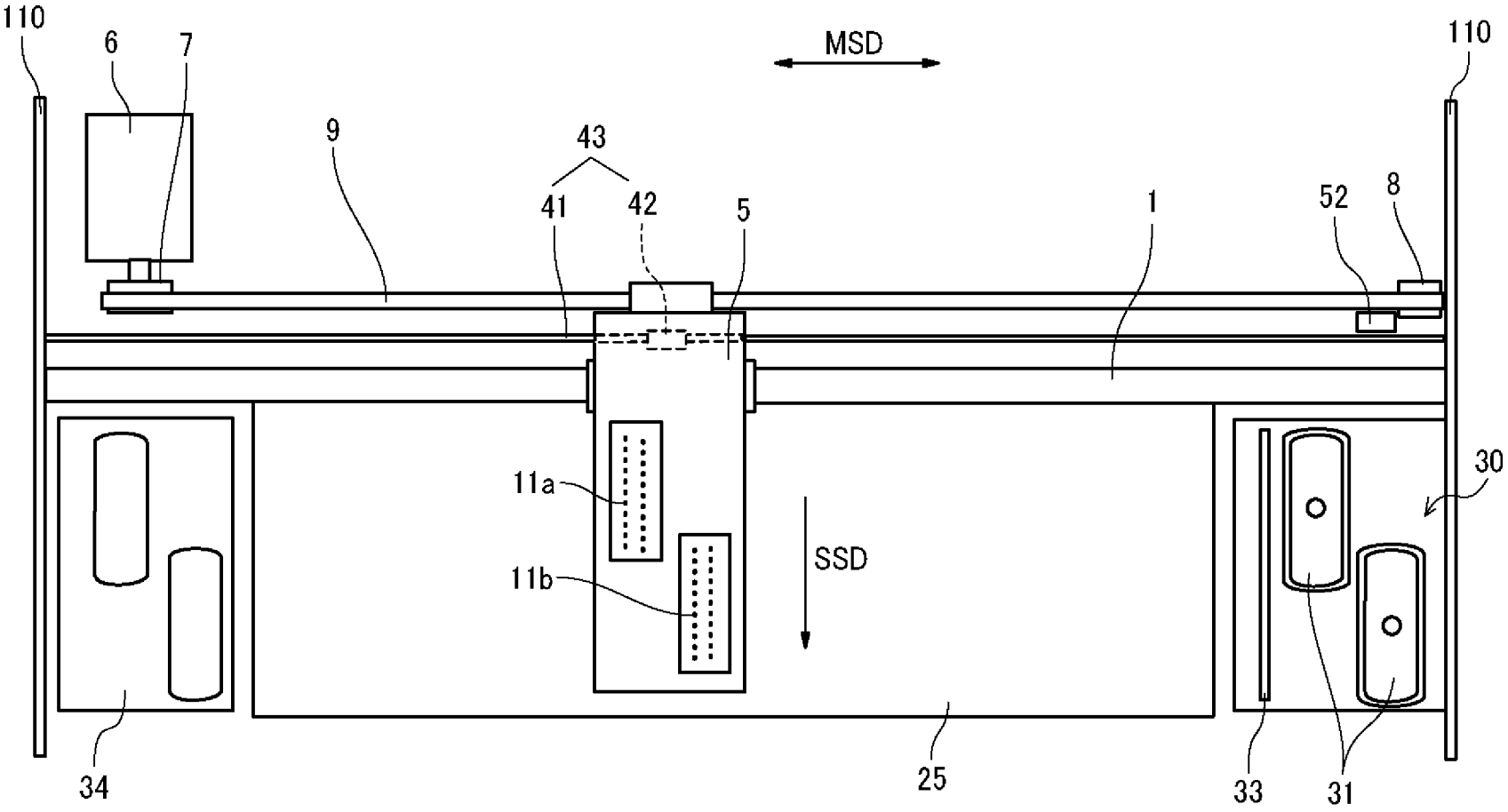
FIG. 2 is an explanatory main part plan view of the printing apparatus.

In the following, an embodiment of the present disclosure will be described referring to the drawings. A printing apparatus according to a first embodiment of the present disclosure will be described referring to FIGS. 1 and 2. FIG. 1 is a schematic explanatory side view of the printing apparatus, and FIG. 2 is an explanatory main part plan view of the printing apparatus.

A printing apparatus 100 is a serial type printing apparatus and includes an apparatus body 101 and a sheet feeder 102 placed under the apparatus body 101.

Inside the apparatus body 101, there is a printing unit 103 that prints an image on a rolled sheet 120, which is a rolled-shaped medium fed by the sheet feeder 102.

In a front side (a side where a printed and cutout rolled sheet 120 is ejected is assumed to be the front side) of the apparatus body 101, there is a ejection port 108 that ejects the rolled sheet 120, on which an image is printed by the printing unit 103, outside the apparatus body 101.

In addition, an upper part and a lower part of the ejection port 108 are formed with an openable access cover 104 provided in a front side of the apparatus body 101 and a lower ejected sheet guide member 105 that guides the rolled sheet 120 to be ejected (including a state after the sheet is cut out).

Below the lower ejected sheet guide member 105, there is a container 106 that contains the rolled sheet 120 ejected as being guided by the lower ejected sheet guide member 105.

In the printing unit 103, a guide member 1 is provided to connect between side plates 110, 110, as illustrated in FIG. 2. To the guide member 1, a carriage 5 is held movably in a main scanning direction.

The carriage 5 is made to move and scan by a main-scanning motor 6 that serves as a driving force placed in one side of the main scanning direction, a drive pulley 7, a driven pulley 8 provided in the other side of the main scanning direction, and a timing belt 9, which is wound around between the drive pulley 7 and driven pulley 8.

In the carriage 5, heads 11 (11*a* and 11*b*) including a plurality of (two in this example) liquid discharge heads are mounted. The head 11 integrates a liquid discharge head and a head tank that provides liquid to the liquid discharge head.

The heads 11*a* and 11*b* are placed as being shifted from each other by a width of one head (a width of one nozzle array) in a sub-scanning direction which is orthogonal to the main scanning direction. Further, the head 11 each includes two nozzle arrays and discharges liquid such as black (K), magenta (M), cyan (C), yellow (Y), and the like.

On the other hand, in a printing area in a main scanning area of the carriage 5, the rolled sheet 120 is fed by the sheet feeder 102 and intermittently conveyed by a conveyor 21 toward a direction (sub-scanning direction) orthogonal to the main scanning direction of the carriage 5.

Further, an encoder scale 41 having a predetermined pattern is stretched along the main scanning direction of the carriage 5 and between the side plates 110 and the carriage 5 includes an encoder sensor 42 composed of a transmissive photosensor that reads the patter of the encoder scale 41. The encoder scale 41 and encoder sensor 42 forms a linear encoder (main-scanning encoder) 43 that detects a movement amount of the carriage 5 or the like.

The conveyor 21 includes a conveying roller 23 that conveys the rolled sheet 120 fed from the sheet feeder 102 and a pressure roller 24 placed opposite to the conveying roller 23. The conveyor 21 also includes a conveyance guide member 25 having a plurality of suction holes and a suction fan 26, which serves as a suction unit that performs suction through the suction holes of the conveyance guide member 25.

In a downstream side of the conveyor 21, there is a cutter 27 that cuts the rolled sheet 120, on which an image is printed by the head 11, in a predetermined length.

Further, in one side of the main scanning direction of the carriage 5, a maintaining and restoring mechanism (maintenance mechanism) 30 that maintains and restores the head 11 is placed next to the conveyance guide member 25. The maintaining and restoring mechanism 30 includes caps 31 that cover nozzle faces of the head 11 of the apparatus body 101 and a wiping member 33 that wipes the nozzle faces.

Further, in the other side of the main scanning direction of the carriage 5, there is an dummy discharge receiver 34 that receives dummy discharge that the heads 11 discharge liquid, which is not used for printing, next to the conveyance guide member 25.

The sheet feeder 102 includes a roll 112. The roll 112 is the sheet 120 as a long rolled medium (this is referred to as a "rolled sheet" as described above) rolled around a tube 114 as a core member.

In the side of the apparatus body 101, there are a guide member 130 that guides a lower face of the rolled sheet 120 pulled out from the roll 112 of the sheet feeder 102 and a pair of conveying rollers 131 that feeds the rolled sheet 120 upward in a curved manner.

When the pair of conveying rollers 131 are driven to rotate, the rolled sheet 120 fed from the roll 112 is conveyed as being stretched between the pair of conveying rollers 131 and roll 112. Then, the rolled sheet 120 is sent, via the pair of the conveying rollers 131, between the conveying roller 23 and pressure roller 24 of the conveyor 21.

In the printing apparatus having the above described configuration, the carriage 5 moves in the main scanning direction and the conveyor 21 intermittently conveys the rolled sheet 120 fed from the sheet feeder 102.

Then, the head 11 is driven and discharges liquid according to image information (print information) to print a necessary image on the rolled sheet 120, and the rolled sheet 120 is cut by the cutter 27 in a necessary length and ejected to the container 106.

Figure 3:
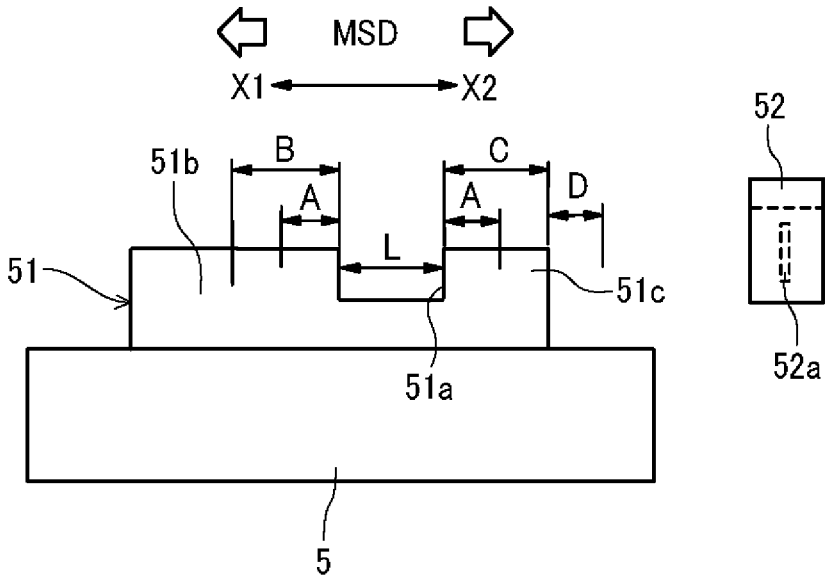
FIG. 3 is an explanatory plan view for explaining a detection target member provided to a carriage and a detector in an apparatus body side.

Next, a detection target member in the carriage and a detector in the apparatus body side will be described referring to FIG. 3. FIG. 3 is an explanatory plan view used in this explanation.

The carriage 5 includes a sensor feeler 51, which is a detection target member, and, the apparatus body side includes a home position sensor 52 composed of a transmissive photosensor, which serves as a detector that detects the sensor feeler 51.

The sensor feeler 51 is a plate-shaped member and has a cutout portion 51*a* having a width L [mm] (hereinafter, the unit [mm] will be omitted, and the unit of other values will also be omitted) in the main scanning direction halfway within the main scanning direction. Here, the cutout portion 51*a* may be formed in a hole-shape.

Note that, in the main scanning direction, a leftward direction is represented by a direction of the arrow X1 (hereinafter, referred to as "leftward direction X1"), and a rightward direction is represented by a direction of the arrow X2 (hereinafter, referred to as "rightward direction X2"). Across the cutout portion 51*a* of the sensor feeler 51, a side in the leftward direction X1 is referred to as a one end 51*b* and a side in the rightward direction X2 is referred to as another end 51*c*.

An output of the home position sensor 52 changes to "detection" state when a sensor detecting position 52*a* composed of a light emitting unit and a light receiving unit is facing to parts of the sensor feeler 51 except for the cutout portion 51*a*. In addition, the output of the home position sensor 52 is changed to "non-detection" when the sensor detecting position 52*a* is not facing to the sensor feeler 51 or is facing to a space corresponding to the cutout portion 51*a* of the sensor feeler 51.

Figure 4:
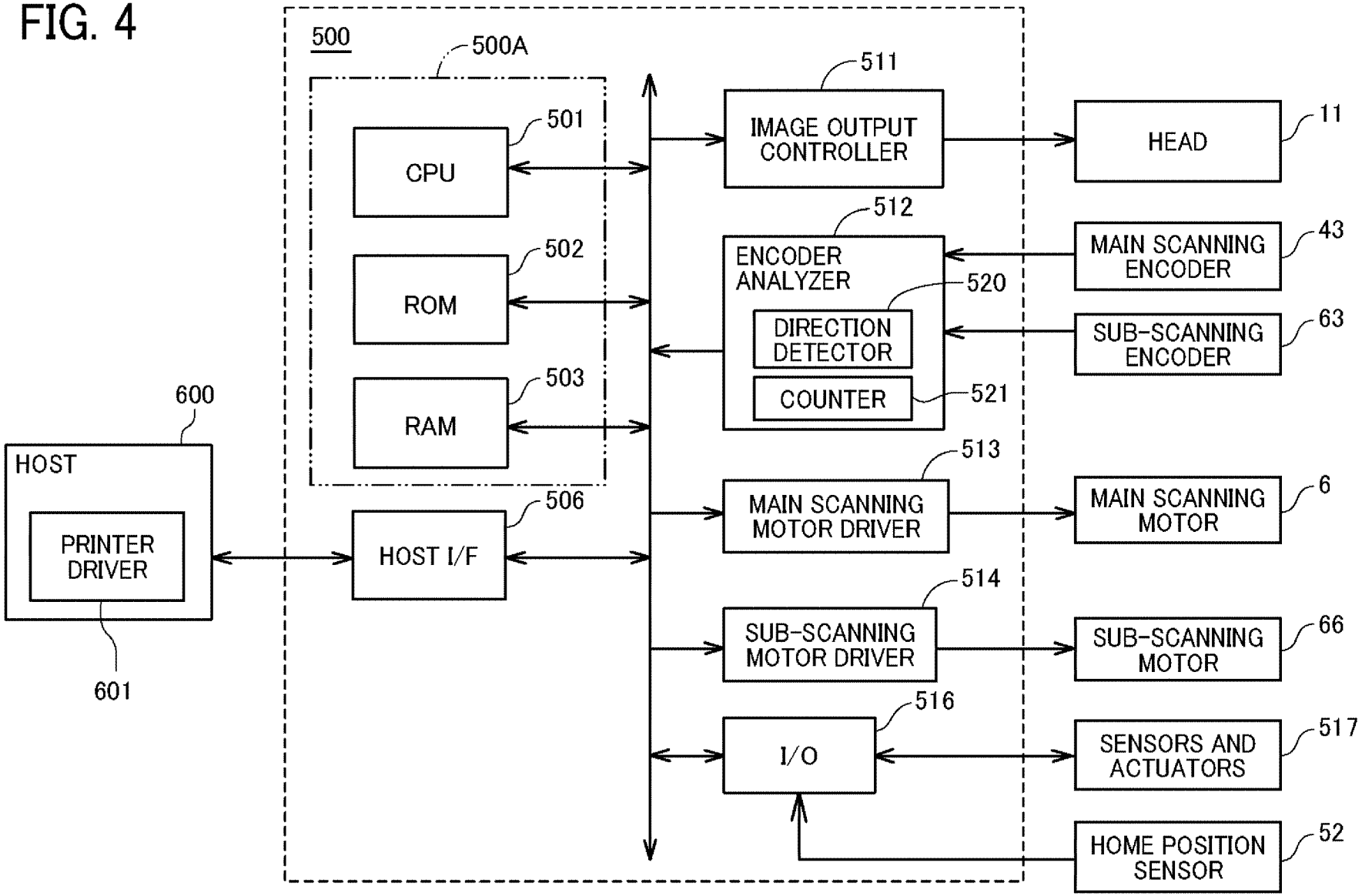
FIG. 4 is an explanatory block view of an outline of a control unit of the printing apparatus.

Next, an outline of a control unit of the printing apparatus will be described referring to FIG. 4. FIG. 4 is an explanatory block view of the control unit.

A control unit 500 includes a main control unit 500A including a central processing unit (CPU) 501, which also serves a as a controller according to an embodiment of the present disclosure and performs an entire control of the apparatus, a read only memory (ROM) 502, which stores a program including a program according to an embodiment of the present disclosure to be executed by the CPU 501 and other pieces of fixed data, and a random-access memory (RAM) 503, which temporarily stores image data or the like.

The control unit 500 also includes a host interface (I/F) 506 that controls data transfer to and from a printer driver 601 of a host (information processing device) 600 such as a personal computer, an image output controller 511 that controls driving of the head 11, and an encoder analyzer 512. The encoder analyzer 512 analyzes an input of a detection signal (output pulse) from the encoder sensor 42 of the main-scanning encoder 43 and from an encoder sensor of a sub-scanning encoder 63. The sub-scanning encoder 63 is a rotary encoder for detecting rotation of the conveying roller 23.

The control unit 500 also includes a main-scanning motor driver 513 that drives the main-scanning motor 6, a sub-scanning motor driver 514 that drives a sub-scanning motor 66, which drives and rotates the conveying roller 23, an input/output (I/O) 516 between various sensors and the actuator 517, and the like. The detection signal from the home position sensor 52 is also input to the I/O 516.

The image output controller 511 includes a data generator for generating print data, a drive signal generator for generating a drive signal used to control driving of the head 11, a data transmitter for transferring a head control signal and print data to select a necessary driving signal from the drive signal, and the like. The image output controller 511 outputs a drive signal, a head control signal, a print data, and the like to a head driver, which is a head drive circuit to drive the head 11 and controls to discharge a liquid drop from the nozzle of the head 11 according to the print data.

The encoder analyzer 512 includes a direction detector 520 that detects a moving direction based on an output pulse (detection signal) from the main-scanning encoder 43 and an output pulse from the sub-scanning encoder 63, and a counter 521 that measures a moving amount by counting (calculating) a number of the output pulses.

The control unit 500 controls driving of the main-scanning motor 6 via the main-scanning motor driver 513 based on the analysis result by the encoder analyzer 512 to control movement of the carriage 5 in the main scanning direction. The control unit 500 also controls driving of the sub-scanning motor 66 via the sub-scanning motor driver 514 based on the analysis result by the encoder analyzer 512 to control feeding of the rolled sheet 120.

When an operation to set the carriage 5 to a home position (homing operation) is performed, the control unit 500 controls movement of the carriage 5 based on a detection result by the home position sensor 52 and refers to a measured value of the output pulse from the main-scanning encoder 43.

Next, control of carriage home position setting operation will be described referring to FIGS. 5A to 8G. FIGS. 5A to 8G are explanatory views used in explanation of a relationship between the home position sensor and sensor feeler and a position setting operation (home position setting method). Note that, in each drawing, the home position sensor 52 is illustrated as the sensor detecting position 52*a*.

Firstly, referring to FIGS. 5A to 5D, a first state that the home position sensor 52 is facing to the one end 51*b*, which is a part of the sensor feeler 51 in a left side of the cutout portion 51*a*, will be described.

Figure 5A:
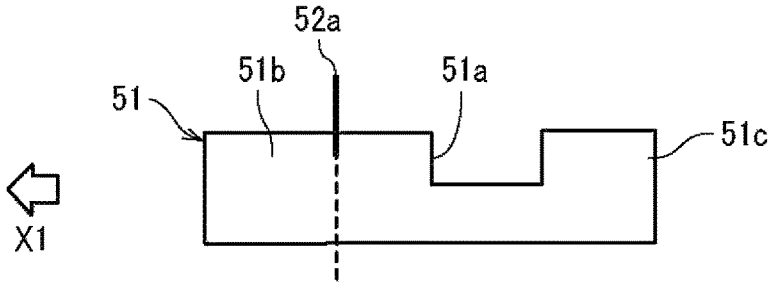
FIGS. 5A to 5D are explanatory views for explaining a position setting operation in a case where a relation between a home position sensor and a sensor feeler is in a first state.

In the first state, as illustrated in FIG. 5A, when the carriage 5 is moved to the leftward direction X1 with respect to the home position sensor 52, the carriage 5 passes by the one end 51*b* of the sensor feeler 51, the cutout portion 51*a*, and the other end 51*c*, which is a part in a right side of the cutout portion 51*a*, in order.

Figure 5B:
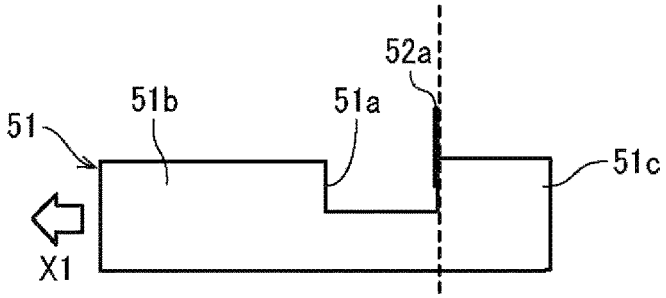

Here, as illustrated in FIG. 5B, a reference position is set to a position where the detection result of the home position sensor 52 changes to "detection" as facing to the other end 51*c* (an edge of the cutout portion 51*a* in the side of the other end 51*c*) after changing from "detection" as facing to the one end 51*b* to "non-detection" as facing to the space corresponding to the cutout portion 51*a*.

Figure 5C:
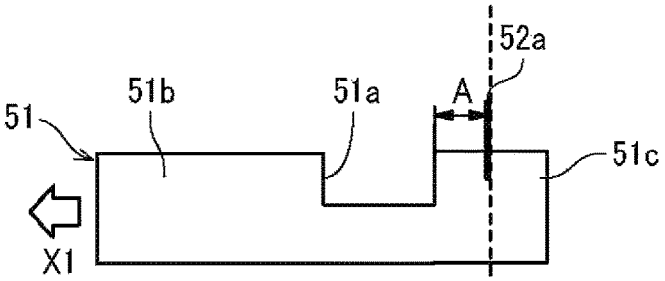

After that, as illustrated in FIG. 5C, the carriage 5 is further moved from the reference position toward the leftward direction X1 by a first predetermined amount A, which is set in advance. Here, the movement amount of the carriage 5 can be detected by counting the output pulse from the main-scanning encoder 43 as described above.

Figure 5D:
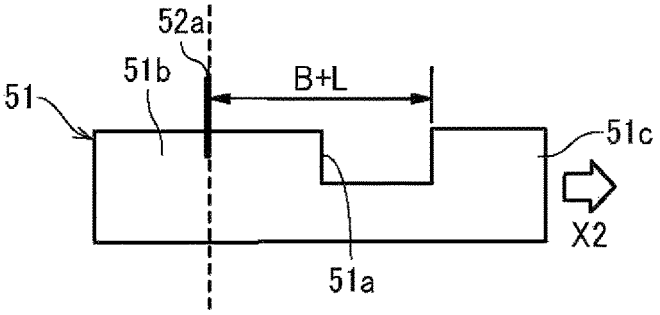

As illustrated in FIG. 5D, the carriage 5 is moved toward the rightward direction X2 and stopped at a home position where the carriage 5 is moved from the reference position by a second predetermined amount (B+L). Note that a distance B represents a position where the home position sensor 52 faces to the one end 51*b* as illustrated in FIG. 3.

Next, referring to FIGS. 6A to 6F, a second state that the home position sensor 52 is facing to the other end 51*c*, which is a part of the sensor feeler 51 in the right side of the cutout portion 51*a*, will be described.

Figure 6A:
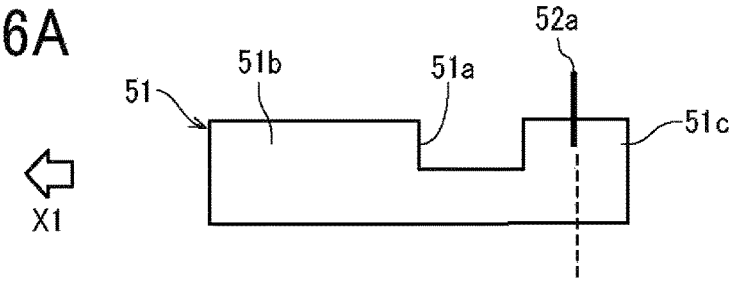
FIGS. 6A to 6F are explanatory views for explaining the position setting operation in a case where the relation between the home position sensor and sensor feeler is in a second state.

In the second state, as illustrated in FIG. 6A, when the carriage 5 is once moved toward the leftward direction X1, the detection result of the home position sensor 52 changes from "detection" as facing to the other end 51*c* to "non-detection" as facing to a space outside the sensor feeler 51.

Figure 6B:
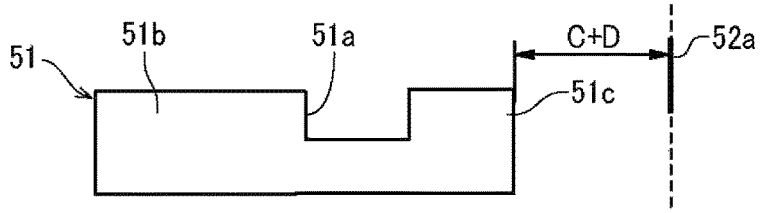

Then, as illustrated in FIG. 6B, the carriage 5 is further moved by a third predetermined amount (C+D), which is set in advance, from a position where the detection result of the home position sensor 52 changes from "detection" to "non-detection." When the result of the home position sensor 52 does not change from "non-detection" to "detection" within the range of the third predetermined amount (C+D), the carriage 5 is stopped at a position after being moved by the third predetermined amount (C+D).

Figure 6C:
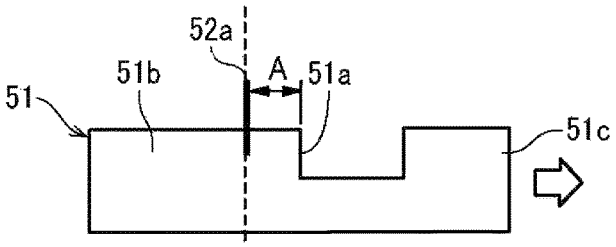

Then, as illustrated in FIG. 6C, the carriage 5 is moved toward the rightward direction X2 and stopped when the carriage 5 is moved by the first predetermined amount A after the detection result of the home position sensor 52 changes from "detection" as facing to the other end 51*c*, "non-detection" as facing to the space corresponding to the cutout portion 51*a*, and then "detection" as facing to the one end 51*b*.

Figure 6D:
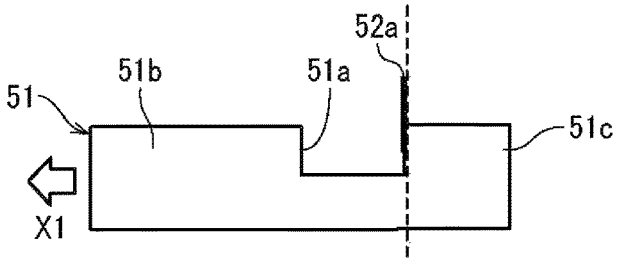

Next, as illustrated in FIG. 6D, the carriage 5 is moved toward the leftward direction X1, and a reference position is detected when the detection result of the home position sensor 52 changes to "detection" as facing to the other end 51*c* (the edge of the cutout portion 51*a* in the side of the other end 51*c*) after changing from "detection" as facing to one end 51*b* to "non-detection" as facing to the space corresponding to the cutout portion 51*a*.

Figure 6E:
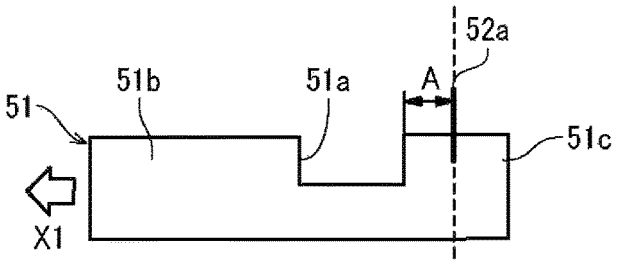

Continuously, as in the case of the first embodiment and as illustrated in FIG. 6E, the carriage 5 is further moved toward the leftward direction X1 from the reference position by the first predetermined amount A, which is set in advance, and then stopped.

Figure 6F:
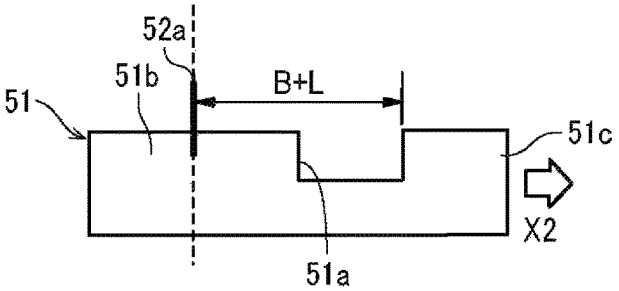

Then, as illustrated in FIG. 6F, the carriage 5 is moved toward the rightward direction X2 and stopped at the home position where the carriage 5 is moved from the reference position by the second predetermined amount (B+L).

Next, by referring to FIGS. 7A to 7E, a third state that the home position sensor 52 is facing to the space corresponding to the cutout portion 51*a* of the sensor feeler 51 will be described.

Figure 7A:
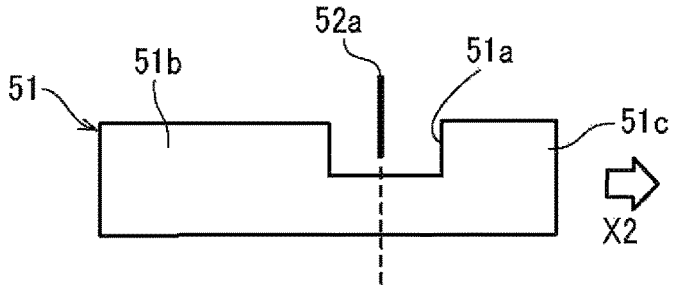
FIGS. 7A to 7E are explanatory views for explaining the position setting operation in a case where the relation between the home position sensor and sensor feeler is in a third state.
Figure 7B:
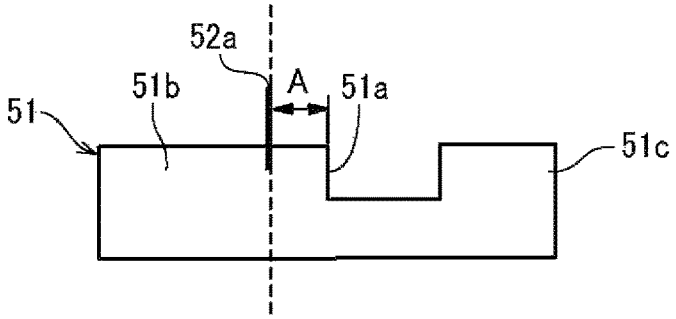

In the third state, as illustrated in FIG. 7A, when the carriage 5 is moved toward the rightward direction X2, the detection result of the home position sensor 52 changes from "non-detection" as facing to the space corresponding to the cutout portion 51*a* to "detection" as facing to the one end 51*b*. Here, as illustrated in FIG. 7B, the carriage 5 is stopped after being further moved toward the rightward direction X2 by the first predetermined amount A from a position where the detection result of the home position sensor 52 becomes "detection."

Figure 7C:
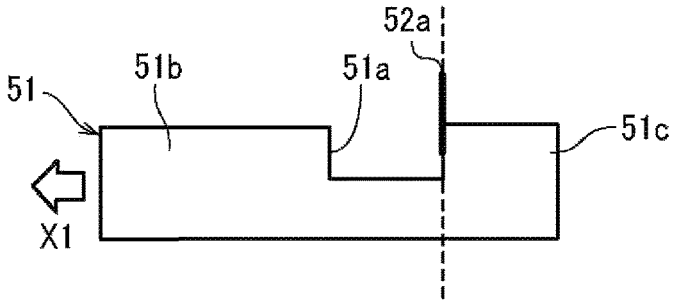

Then, as illustrated in FIG. 7C, the carriage 5 is moved to the leftward direction X1, and a reference position is detected when the detection result of the home position sensor 52 changes from "detection" as facing to the one end 51*b*, "non-detection" as facing to the space corresponding to the cutout portion 51*a*, and then "detection" as facing to the other end 51*c* (the edge of the cutout portion 51*a* in the side of the other end 51*c*).

Figure 7D:
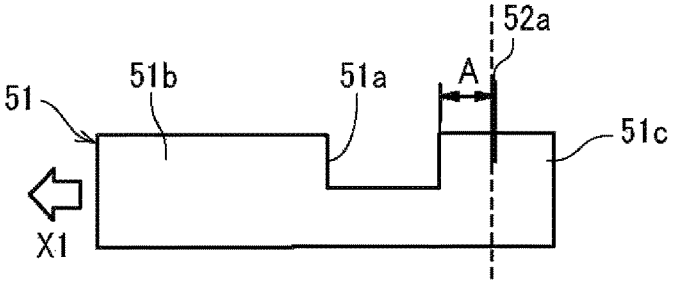

After that, as in the case of the first embodiment and as illustrated in FIG. 7D, the carriage 5 is stopped after being further moved toward the leftward direction X1 from the reference position by the first predetermined amount A, which is set in advance.

Figure 7E:
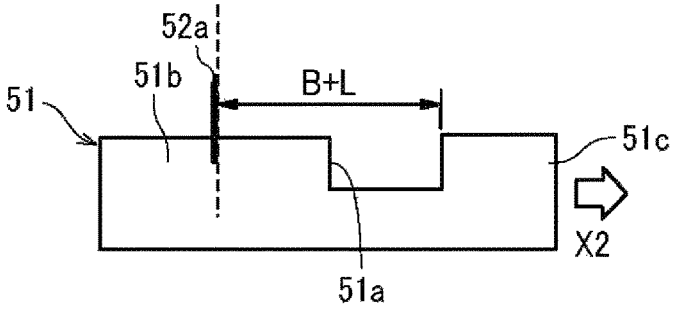

Then, as illustrated in FIG. 7E, the carriage 5 is moved toward the rightward direction X2 and stopped at a home position where the carriage 5 is moved by the second predetermined amount (B+L) from the reference position.

Next, referring to FIGS. 8A to 8G, a fourth state that the home position sensor 52 is not facing to the sensor feeler 51 and placed in a right side of the sensor feeler 51 will be described.

Figure 8A:
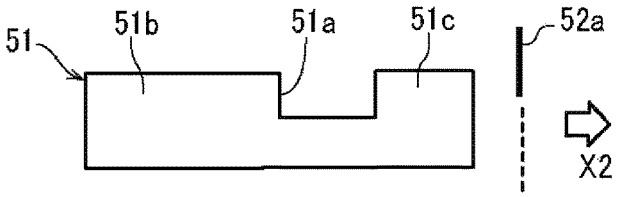
FIGS. 8A to 8G are explanatory views for explaining the position setting operation in a case where the relation between the home position sensor and sensor feeler is in a fourth state.

In the fourth state, as illustrated in FIG. 8A, when the carriage 5 is moved toward the rightward direction X2, the detection result of the home position sensor 52 changes from "non-detection" as facing to a space outside the sensor feeler 51 to "detection" as facing to the other end 51*c*.

Figure 8B:
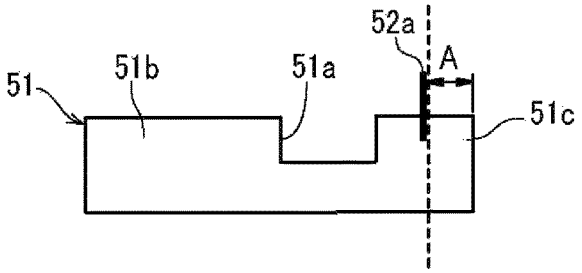

Then, as illustrated in FIG. 8B, the carriage 5 is stopped after being further moved toward the rightward direction X2 by the first predetermined amount A from a position where the detection result of the home position sensor 52 becomes "non-detection."

Figure 8C:
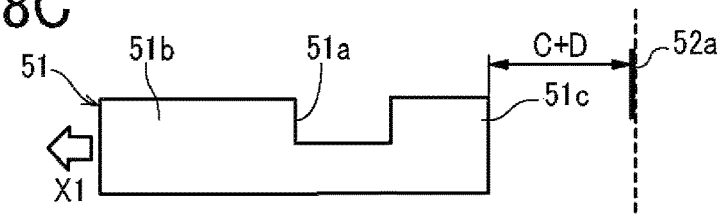

Then, as illustrated in FIG. 8C, when the carriage 5 is moved toward the leftward direction X1, the detection result of the home position sensor 52 changes from "detection" as facing to the other end 51*c* to "non-detection" as facing to a space outside the sensor feeler 51.

Here, the carriage 5 is moved by the third predetermined amount (C+D), which is set in advance, from a position where the detection result of the home position sensor 52 changes from "detection" to "non-detection." When the result of the home position sensor 52 does not change from "non-detection" to "detection" within the range of the third predetermined amount (C+D), the carriage 5 is stopped at a position after being moved by the third predetermined amount (C+D).

Figure 8D:
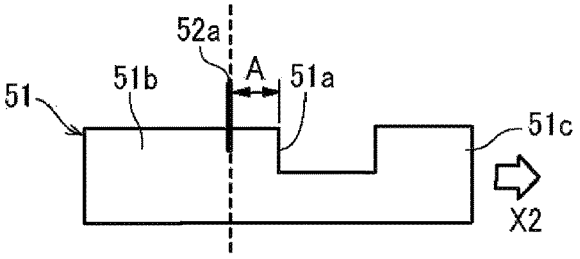

Then, as illustrated in FIG. 8D, the carriage 5 is moved toward the rightward direction X2 and stopped after being moved by the first predetermined amount A from a position where the detection result of the home position sensor 52 changes from "detection" as facing to the other end 51*c*, "non-detection" as facing to the space corresponding to the cutout portion 51*a*, and then "detection" as facing to the one end 51*b*.

Figure 8E:
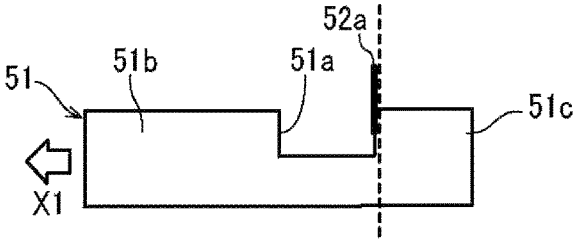

Next, as illustrated in FIG. 8E, the carriage 5 is moved toward the leftward direction X1, and a reference position is detected at a position where the detection result of the home position sensor 52 becomes "detection" as facing to the other end 51*c* (the edge of the cutout portion 51*a* in the side of the other end 51*c*) after changing from "detection" as facing to the one end and then "non-detection" as facing to the space corresponding to the cutout portion 51*a*.

Figure 8F:
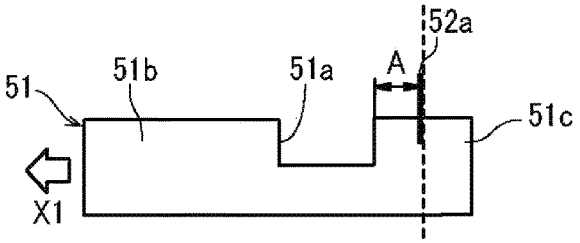

Continuously, as in the case of the first embodiment and as illustrated in FIG. 8F, the carriage 5 is stopped after being further moved toward the leftward direction X1 from the reference position by the first predetermined amount A, which is set in advance.

Figure 8G:
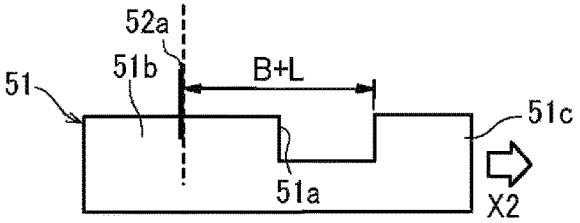

Then, as illustrated in FIG. 8G, the carriage 5 is moved toward the rightward direction X2 and stopped at a home position where the carriage 5 is moved by the second predetermined amount (B+L) from the reference position.

In other words, when the home position setting operation (homing operation) of the carriage 5 is started, the detection result of the home position sensor 52 is referred and, based on the detection result and a position relation between the home position sensor 52 and sensor feeler 51, operation in four patterns including the first to fourth states is performed.

In both of the first and second states, the homing operation is started while detecting the sensor feeler 51; however, it cannot be recognized which position in the first state or second state the carriage 5 is placed.

Then, the detection result of the home position sensor 52 changes from "detection" to "non-detection," and it is determined whether it is in the first state or second state based on whether a next detection is made within the third predetermined amount (C+D).

Regarding the third state and fourth state, it is determined which state is being detected in a similar procedure.

Here, for example, in the first state, as illustrated in FIGS. 5B and 5C, after setting the position where the edge of the cutout portion 51*a* is detected as the reference position and the carriage 5 is controlled to move in an opposite direction after being moved by the first predetermined amount A.

On the other hand, when the carriage 5 is stopped immediately after detecting the edge of the cutout portion 51*a* and the carriage 5 is moved in the opposite direction, the detection of the edge of the cutout portion 51*a* becomes unstable due to vibration or the like of the carriage 5 or the apparatus and this may cause an error detection.

Thus, in all cases of the first to fourth states, since the carriage 5 is stopped after being moved by the first predetermined amount A after detecting the edge of the cutout portion 51*a* of the sensor feeler 51, an error detection of the home position sensor 52 can be prevented.

Further, where the reference position is set and the reference position is detected at a position where the detection result of the home position sensor 52 changes from "detection," "non-detection," to "detection" only based on the detection results, the home position sensor 52 may make an error detection by detecting an edge of the cutout portion 51*a* at an unexpected position due to chattering or the like.

Here, according to the present embodiment, an error detection is prevented by combining the number of output pulses of the main-scanning encoder 43 with the detection result.

More specifically, the number of output pulses from the main-scanning encoder 43 is counted (measured) from when the detection result of the home position sensor 52 changes from "detection" to "non-detection" until when the detection result changes to "detection" again, that is while the result changes from "detection," "non-detection," to "detection."

Then, it is confirmed whether or not the count value (measured value) of the output pulses is equal to or greater than a predetermined value, which is set in advance based on a distance between the edges of the cutout portion 51*a* (the width L in the main scanning direction). Here, the predetermined value corresponds to a distance (width) which is a little shorter than the distance (the width L in the main scanning direction) between the edges of the cutout portion 51*a*.

With this configuration, in a case where the detection result of the home position sensor 52 changes from "non-detection" to "detection" and the number of output pulses while the detection result is "non-detection" is equal to or greater than the predetermined value, since it is assumed that the cutout portion 51*a* is properly detected, it is determined that the position where the result changes from "non-detection" to "detection" is a proper position.

On the other hand, in a case where the detection result of the home position sensor 52 changes from "detection," "non-detection," to "detection" and the number of output pulses while the detection result is "non-detection" is smaller than the predetermined value, since it is assumed that the cutout portion 51*a* is not properly detected, it is determined that the homing operation has failed and the homing operation starts over.

Further, also in a case where the carriage 5 is moved to the home position after setting the reference position in the first to fourth states, by performing a determination process based on the number of output pulses of the above main-scanning encoder 43, error detection of counting the number of output pulses due to a stain or the like of the encoder scale 41 is prevented and the homing operation can be executed more certainly.

Figure 9:
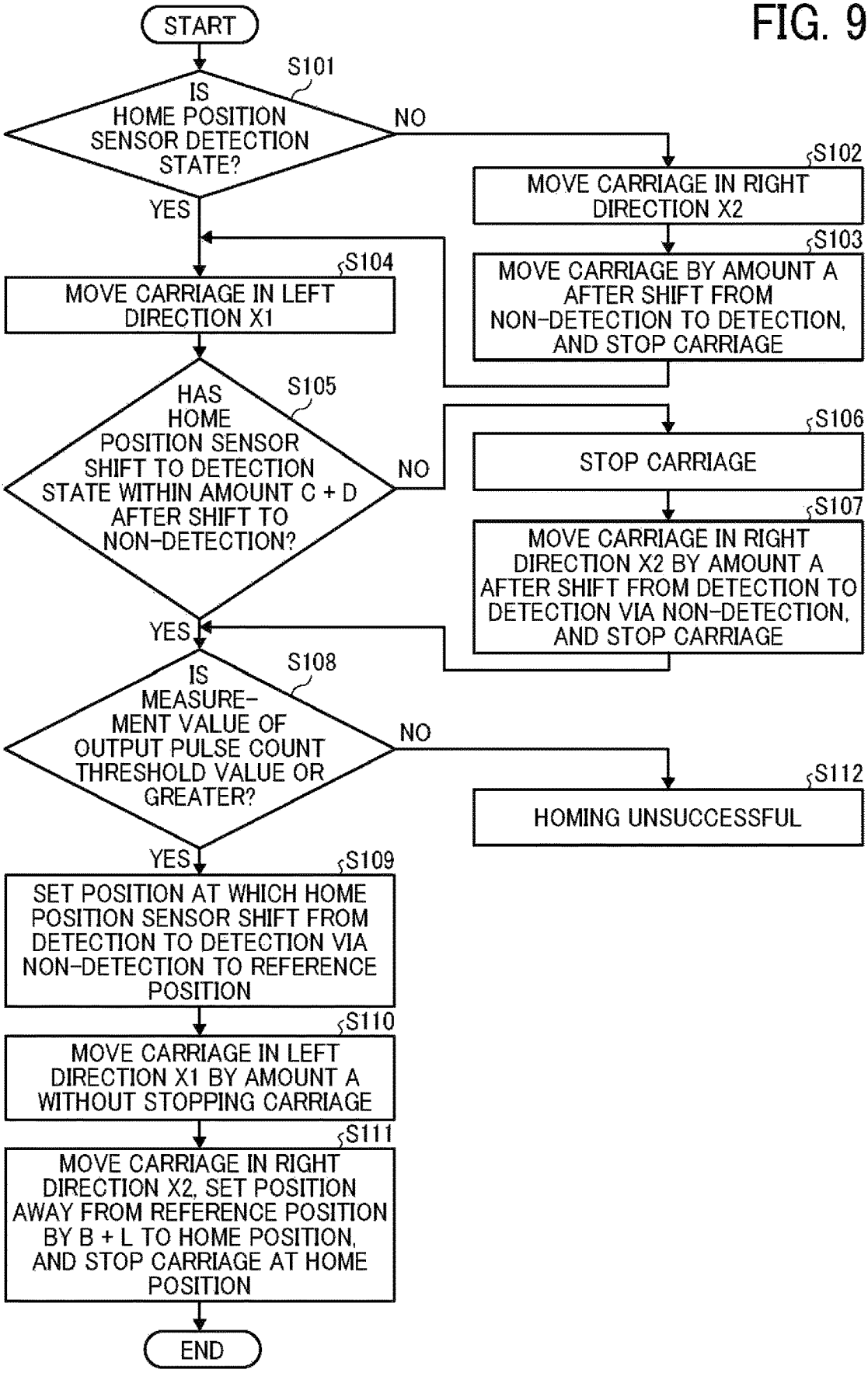
FIG. 9 is a flowchart for explaining control of a home position setting operation performed by a computer of a control unit based on a program according to an embodiment of the present disclosure.

Next, control of the home position setting operation (homing operation) that a computer of the control unit executes based on a program according to an embodiment of the present disclosure will be described referring to the flowchart of FIG. 9.

At S101, it is determined whether or not the detection result of the home position sensor 52 is "detection." With this configuration, it can be determined whether it is in the first state or second state or in the third state or fourth state.

Here, when the detection result of the home position sensor 52 is not "detection," that is, in a case of "non-detection," since it is assumed that one of the third state and the fourth state is being detected, at S102 the carriage 5 is moved toward the rightward direction X2. At S103, the carriage 5 is stopped after being moved by the first predetermined amount A from a position where the detection result of the home position sensor 52 changes from "non-detection" to "detection."

After that, when the detection result of the home position sensor 52 is "detection" again, at S104 the carriage 5 is continuously moved toward the leftward direction X1.

At S105, it is determined whether or not the detection result of the home position sensor 52 changes to "detection" within the third predetermined amount (C+D) from the position where the detection result of the home position sensor 52 changes to "non-detection." With this configuration, it can be determined whether the first state or second state, or the third state or fourth state is being detected.

Here, when the detection result of the home position sensor 52 does not change to "detection" within the third predetermined amount (C+D) from the position where the detection result of the home position sensor 52 changes to "non-detection," at S106 the carriage 5 is stopped at a position where the carriage 5 is moved by the third predetermined amount (C+D).

At S107, the carriage 5 is moved toward the rightward direction X2 and stopped after being moved by the first predetermined amount A from the position where the detection result of the home position sensor 52 changes from "detection," "non-detection," to "detection."

After that, when the detection result of the home position sensor 52 changes to "detection" within the third predetermined amount (C+D) from the position where the detection result of the home position sensor 52 changes to "non-detection" again, at S108 it is determined whether or not the count value of the number of output pulses of the main-scanning encoder 43 when the detected result changes from "detection," "non-detection," and "detection" is equal to or greater than a predetermined value.

Here, when the count value of the number of output pulses of the main-scanning encoder 43 is equal to or greater than the predetermined value, since the detection result can be determined as a normal result, at S109 a position where the result changes to "detection" again after changing from "detection" to "non-detection" is set as a reference position.

At S110, the carriage 5 is further moved toward the leftward direction X1 by the first predetermined amount A without being stopped and then the carriage 5 is stopped.

At S111, the carriage 5 is moved toward the rightward direction X2 and stopped at the home position where the carriage 5 is moved from the reference position by the second predetermined amount (B+L).

On the other hand, when the count value of the number of output pulses of the main-scanning encoder 43 is smaller than the predetermined value, at S112 it is determined that the homing operation has failed and the process ends. The failure of the homing operation may include a foreign substance, a sensor trouble, or the like, and the homing operation may be started over.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A printing apparatus comprising:

an apparatus body;

a carriage;

an encoder configured to detect an amount of movement of the carriage in a main scanning direction;

a detection target member disposed on the carriage and having a cutout portion halfway in the main scanning direction;

a detector disposed on the apparatus body and configured to detect the detection target member; and circuitry configured to control a position setting operation for setting a home position of the carriage based on a detection result of detection or non-detection of the detection target member with the detector, the circuitry configured to:

measure an output pulse of the encoder from when the detection result of the detector changes from detection to non-detection until when the detection result changes from non-detection to detection; and determine whether a measured value of the output pulse is equal to or greater than a predetermined value that is set in advance based on a width of the cutout portion in the main scanning direction.

2. The printing apparatus according to claim 1, wherein the circuitry is configured to:

set a reference position to a position at which the detection result of the detector changes from non-detection to detection after changing from detection to non-detection, when the measured value is equal to or greater than the predetermined value; and set a home position to a position at which the carriage is moved from the reference position by a first predetermined amount toward a first direction in which the detection result of the detector continues to indicate detection and is then moved toward a second direction opposite the first direction by a second predetermined amount from a position at which the carriage is moved by the first predetermined amount, and wherein the second predetermined amount is a movement amount greater than the width of the cutout portion in the main scanning direction and the first predetermined amount.

3. A home position setting method for setting a home position of a carriage of an apparatus, the method comprising:

detecting a detection target member with a detector disposed on an apparatus body of the apparatus, the detection target member being disposed on the carriage that moves in a main scanning direction, the detection target member having a cutout portion halfway in the main scanning direction; and providing circuitry, the circuitry setting a home position of the carriage based on a detection result of detection or non-detection of the detection target member with the detector, the setting the home position of the carriage including:

the circuitry measuring an output pulse of an encoder detecting a movement amount of the carriage from when the detection result of the detector changes from detection to non-detection until when the detection result changes from non-detection to detection; and the circuitry determining whether a measured value of the output pulse is equal to or greater than a predetermined value that is set in advance based on a width of the cutout portion in the main scanning direction.

4. The home position setting method according to claim 3, further comprising:

the circuitry, setting a reference position to a position at which the detection result of the detector changes from non-detection to detection after changing from detection to non-detection, when the measured value is equal to or greater than the predetermined value; and setting a home position to a position at which the carriage is moved from the reference position by a first predetermined amount toward a first direction in which the detection result of the detector continues to indicate detection and then toward a second direction opposite the first direction by a second predetermined amount from a position at which the carriage is moved by the first predetermined amount, wherein the second predetermined amount is a movement amount greater than the width of the cutout portion in the main scanning direction and the first predetermined amount.

5. A non-transitory recording medium storing computer-readable program code which causes a computer to execute processing comprising:

detecting, using circuitry, a detection target member with a detector disposed on an apparatus body of the apparatus, the detection target member being disposed on the carriage that moves in a main scanning direction, the detection target member having a cutout portion halfway in the main scanning direction; and setting, using the circuitry, a home position of the carriage based on a detection result of detection or non-detection of the detection target member with the detector, the setting the home position of the carriage including:

measuring, using the circuitry, an output pulse of an encoder detecting a movement amount of the carriage from when the detection result of the detector changes from detection to non-detection until when the detection result changes from non-detection to detection; and determining, using the circuitry, whether a measured value of the output pulse is equal to or greater than a predetermined value that is set in advance based on a width of the cutout portion in the main scanning direction.

6. The non-transitory recording medium according to claim 5, wherein the processing further including:

setting, using the circuitry, a reference position to a position at which the detection result of the detector changes from non-detection to detection after changing from detection to non-detection, when the measured value is equal to or greater than the predetermined value; and setting, using the circuitry, a home position to a position at which the carriage is moved from the reference position by a first predetermined amount toward a first direction in which the detection result of the detector continues to indicate detection and then toward a second direction opposite the first direction by a second predetermined amount from a position at which the carriage is moved by the first predetermined amount, and wherein the second predetermined amount is a movement amount greater than the width of the cutout portion in the main scanning direction and the first predetermined amount.

* * * * *